US011543090B1

(12) United States Patent
Chen

(10) Patent No.: US 11,543,090 B1
(45) Date of Patent: Jan. 3, 2023

(54) DECORATIVE LIGHT-EMITTING NET BAG

(71) Applicant: ZHU HAI FUYUN LIGHTING INDUSTRIAL CO., LTD., Zhuhai (CN)

(72) Inventor: Su-Hua Chen, Zhuhai (CN)

(73) Assignee: ZHU HAI FUYUN LIGHTING INDUSTRIAL CO., LTD., Zhuhai (CN)

( * ) Notice: Subject to any disclaimer, the term of this patent is extended or adjusted under 35 U.S.C. 154(b) by 0 days.

(21) Appl. No.: 17/728,489

(22) Filed: Apr. 25, 2022

(51) Int. Cl.

| | |
|---|---|
| ***F21S 4/15*** | (2016.01) |
| ***F21V 15/01*** | (2006.01) |
| ***F21V 23/04*** | (2006.01) |
| ***F21S 9/02*** | (2006.01) |
| ***F21V 23/00*** | (2015.01) |
| ***A45C 15/06*** | (2006.01) |
| ***F21Y 115/10*** | (2016.01) |

(52) U.S. Cl.
CPC ..... *F21S 4/15* (2016.01); *A45C 15/06* (2013.01); *F21S 9/02* (2013.01); *F21V 15/01* (2013.01); *F21V 23/003* (2013.01); *F21V 23/04* (2013.01); *F21Y 2115/10* (2016.08)

(58) Field of Classification Search
CPC .... F21S 4/15; F21S 4/10; A45C 15/06; A45C 7/0077
See application file for complete search history.

(56) References Cited

U.S. PATENT DOCUMENTS

| | | | | |
|---|---|---|---|---|
| 5,716,124 | A * | 2/1998 | Hsu | F21S 4/10 362/249.02 |
| 7,036,962 | B2 * | 5/2006 | Chan | A44C 15/0015 362/249.05 |
| 8,356,926 | B1 * | 1/2013 | Sanders | F21S 4/15 362/652 |
| 11,181,242 | B2 * | 11/2021 | Stange | F21V 23/06 |
| 2008/0038506 | A1 * | 2/2008 | Schumacher | F21S 4/20 174/250 |
| 2017/0023223 | A1 * | 1/2017 | Tsai | F21V 23/06 |
| 2018/0259167 | A1 * | 9/2018 | Krieger | F21K 9/20 |
| 2019/0368670 | A1 * | 12/2019 | Gao | F21S 4/15 |
| 2020/0352301 | A1 * | 11/2020 | Blanchard | A01K 15/025 |

* cited by examiner

*Primary Examiner* — William N Harris
(74) *Attorney, Agent, or Firm* — Rabin & Berdo, P.C.

(57) ABSTRACT

A decorative light-emitting net bag includes a net bag with a plurality of mesh openings, a light-emitting assembly, and a plurality of light-permeable protective enclosures. One side of the net bag is provided with a bag opening, and a receiving space is formed in the net bag so that the net bag can receive or be mounted over a to-be-decorated object. The light-emitting assembly at least includes a plurality of light-emitting diode (LED) lamp beads distributed on the net bag. The light-permeable protective enclosures are configured to enclose the LED lamp beads respectively and to secure each LED lamp bead to at least one net string of the net bag. Each light-permeable protective enclosure is penetrated by a receiving groove for receiving the corresponding LED lamp bead and allowing passage of the net string so as to secure the corresponding LED lamp bead in position on the net string.

20 Claims, 12 Drawing Sheets

DECORATIVE LIGHT-EMITTING NET BAG

BACKGROUND OF THE INVENTION

1. Technical Field

The present invention relates to a light decoration for the environment. More particularly, the invention relates to a decorative light-emitting net bag that is easy to use and has multiple application modes.

2. Description of Related Art

On holidays such as the New Year holidays, light decorations are typically used to decorate the environment and add to the festive atmosphere. While light decorations for use on festive occasions abound on the market, the conventional ones are so designed that they are not necessarily suitable for each and every holiday, which has different features from one another; as a result, dedicated light decorations must be prepared for each holiday. This causes not only inconvenience, but also a wasteful use of such products now that the utilization rate of each is low.

Recently, there has been continual improvement on light string products for decorating the environment. The improved light strings can be arranged as desired, are of universal use, and have gradually become one of the most popular light decorations. The existing light strings, however, are generally connected by wires alone, lack proper protection, have limited resistance to a pulling or other external force, and are hence prone to damage, disintegration, forming an open circuit, and having a short service life. Moreover, while a light string can be flexibly arranged, the arrangement process still takes a lot of work and may cause difficulties in cases where the light string is to be used in conjunction with other decorative objects. It is therefore a goal for those in the related industries to eliminate the aforesaid drawbacks and produce optimized products while catering for user needs.

BRIEF SUMMARY OF THE INVENTION

The primary objective of the present invention is to provide a decorative light-emitting net bag that can be easily used and arranged in various ways so as to serve as a light decoration that can be disposed individually, or mounted over another decorative object, or hung when incorporating a hanging function.

Furthermore, the decorative light-emitting net bag of the present invention is so configured that the net string of the net bag has a supporting function to prevent an external force from concentrating on and thus damaging the conductive wire of the light decoration, and that the light-permeable protective enclosures provide complete protection for, help position, and can diffuse the light of, the light-emitting diode (LED) lamp beads, thereby ensuring the durability and decorativeness of the product.

To achieve the foregoing objective and effects, the main technical features of the present invention and the technical means adopted thereby include a net bag, a light-emitting assembly, and a plurality of light-permeable protective enclosures. The net bag has a plurality of mesh openings, is provided with a bag opening on one side, and is formed with a receiving space in the net bag in order to receive or be mounted over a to-be-decorated object. The light-emitting assembly at least includes a plurality of LED lamp beads distributed on the net bag. The light-permeable protective enclosures are configured to enclose the LED lamp beads respectively and to secure each LED lamp bead to at least one net string of the net bag. Each light-permeable protective enclosure is also provided with and penetrated by a receiving groove for receiving the corresponding LED lamp bead and allowing passage of the net string so as to secure the corresponding LED lamp bead in position on the net string.

The foregoing decorative light-emitting net bag may be so designed that the light-emitting assembly includes at least one light string; that the light string includes a conductive wire that extends linearly; that the LED lamp beads are provided at intervals on the conductive wire; that the receiving groove of each light-permeable protective enclosure further allows passage of the conductive wire so as to secure the corresponding LED lamp bead, the conductive wire, and the net string in position; that each section of the conductive wire that extends between two adjacent light-permeable protective enclosures is longer than or as long as each section of the net string that extends between two adjacent light-permeable protective enclosures; and that the LED lamp beads are surface-mount-device (SMD) LEDs.

The foregoing decorative light-emitting net bag may be so designed that the net bag further includes a drawstring for tightening the bag opening, that the net bag is further provided with a ring-shaped bag eyelet on a side located away from the bag opening, and that the net string extends sinuously between the drawstring and the bag eyelet to form therebetween a plurality of net string junctions, where the net string meets itself, and the mesh openings.

The foregoing decorative light-emitting net bag may be so designed that the light string extends sinuously between the drawstring and the bag eyelet, that each light-permeable protective enclosure is configured to secure the corresponding LED lamp bead and the conductive wire to the corresponding net string junction, that the light string forms between the drawstring and the bag eyelet a plurality of conductive wire junctions corresponding respectively to the net string junctions, and that each light-permeable protective enclosure is configured to enclose and secure the corresponding net string junction, the corresponding conductive wire junction, and the LED lamp bead at the corresponding conductive wire junction.

The foregoing decorative light-emitting net bag may be so designed that each light-permeable protective enclosure at least includes a main body penetrated by the corresponding receiving groove, and that each main body forms a generally hemispherical outer surface on a lateral side of the corresponding receiving groove. Alternatively, the foregoing decorative light-emitting net bag may be so designed that each light-permeable protective enclosure includes a main body and a cover; that the side of each main body that is adjacent to the corresponding cover is concavely provided with the corresponding receiving groove, which penetrates two opposite lateral sides of the main body; that each cover is configured to cover the side of the corresponding receiving groove that faces away from the corresponding main body; and that the side of each main body that faces away from the corresponding cover forms a generally hemispherical outer surface.

The foregoing decorative light-emitting net bag may be so designed that each main body is provided with one of at least one tenon and at least one mortise engageable with the at least one tenon, that each cover is provided with the other of the at least one tenon and the at least one mortise, and that the side of each cover that faces away from the corresponding main body is provided with an attaching portion configured to be positioned on the outer surface of the to-be-decorated object.

The foregoing decorative light-emitting net bag may be so designed that the conductive wire is a double-wire cable and essentially includes two power supply wires that extend parallel to each other, and that each LED lamp bead is connected in parallel between the two power supply wires. Alternatively, the foregoing decorative light-emitting net bag may be so designed that the conductive wire is a triple-wire cable further including a signal wire extending parallel to the two power supply wires in order to enable signal transmission between the LED lamp beads and a controller.

The foregoing decorative light-emitting net bag may be so designed that the light-emitting assembly further includes a controller connected to one end of the conductive wire, that the controller is provided at least with a power source and a switch so as to drive, or stop driving, the LED lamp beads to emit light, that the power source includes at least one electricity storage unit detachably connected to the controller, and that the electricity storage unit may be further provided with a connection port for connecting and delivering external electricity to the electricity storage unit.

The foregoing decorative light-emitting net bag may be so designed that the controller has at least one hook or hanging portion. For example, each of two opposite sides of the controller may be provided with a hook or a hanging portion, with the hook or hanging portion on one of the two opposite sides of the controller allowing the controller to be hung, and the hook or hanging portion on the other of the two opposite sides of the controller allowing the drawstring to be hung from the controller either directly or via at least one hanging cord.

BRIEF DESCRIPTION OF THE SEVERAL VIEWS OF THE DRAWINGS

The aforementioned objective, effects, and features of the present invention can be better understood by referring to the following detailed description of some preferred embodiments of the invention in conjunction with the accompanying drawings, in which.

DETAILED DESCRIPTION OF THE INVENTION

Figure 1:
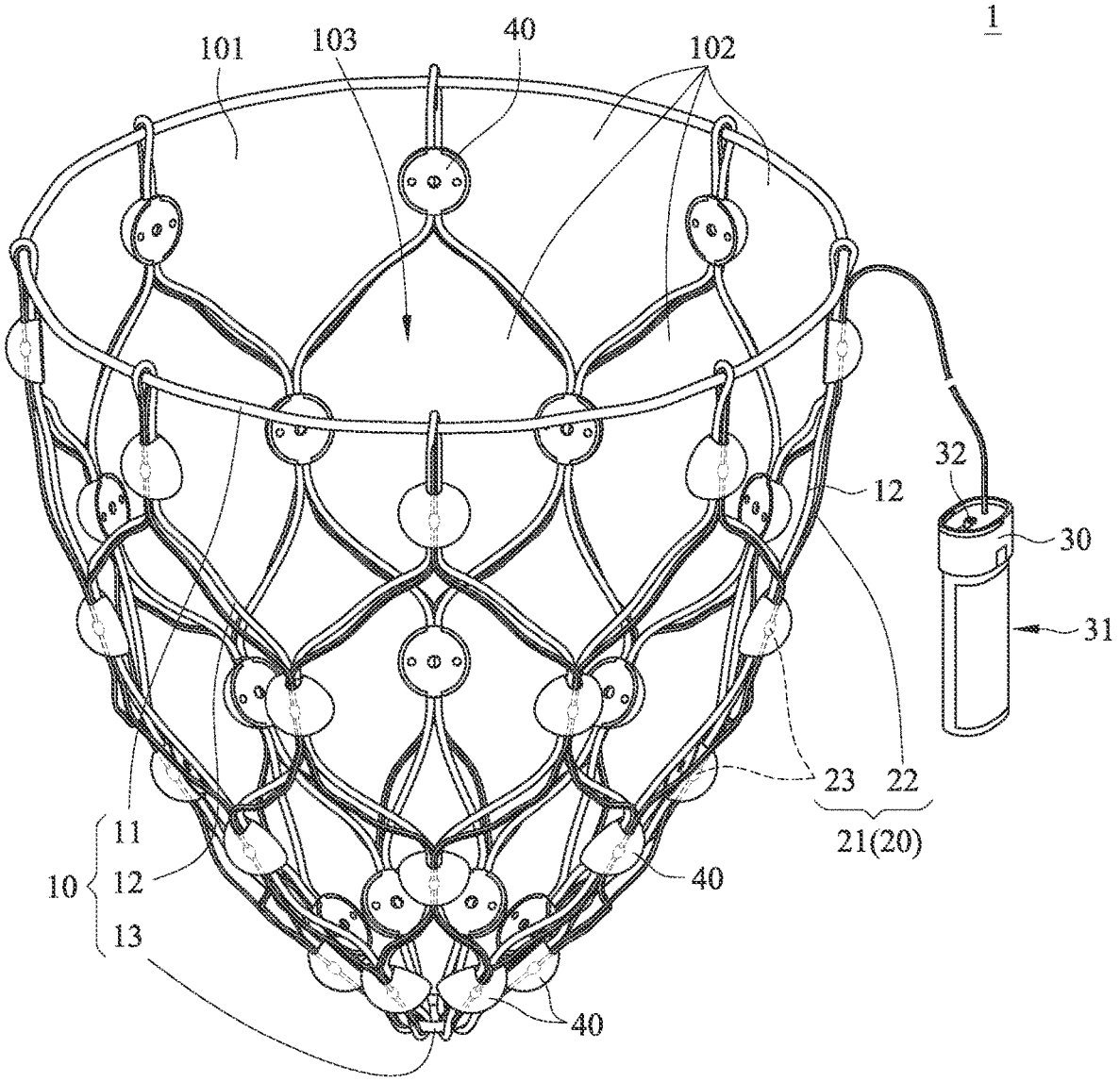
FIG. 1 is a perspective view of an embodiment of the invention.

Referring to FIG. 1 to FIG. 4, the decorative light-emitting net bag 1 according to an embodiment of the present invention is composed of a net bag 10, a light-emitting assembly 20, a controller 30, and a plurality of light-permeable protective enclosures 40.

The net bag 10 is composed essentially of at least one string and forms a structure that has a bag opening 101 on one side, a plurality of mesh openings 102 in the body of the net bag 10 (hereinafter referred to as the net body), and a receiving space 103 in the net bag 10. The at least one string of the net bag 10 essentially includes three portions: a drawstring 11 located around the bag opening 101, a net string 12 that extends sinuously to form the net body, and a bag eyelet 13 located away from the bag opening 101. The three portions may be formed by a single string or by three strings respectively. In this embodiment, each of the drawstring 11 and the bag eyelet 13 is composed of an annular string, and the net string 12 of the net body is a string that extends sinuously between the drawstring 11 and the bag eyelet 13 to form therebetween a plurality of net string junctions 121, where the net string 12 meets itself, and the mesh openings 102.

The light-emitting assembly 20 essentially includes a plurality of LED lamp beads 23 distributed on the net bag 10. In this embodiment, the light-emitting assembly 20 is formed by a winding light string 21. The light string 21 includes a conductive wire 22 that extends linearly, and the LED lamp beads 23 are provided at intervals on the conductive wire 22. The light string 21 extends sinuously between the drawstring 11 and the bag eyelet 13 to form therebetween a plurality of conductive wire junctions 223 that correspond to the net string junctions 121 respectively.

The controller 30 is electrically connected to the LED lamp beads 23 and is configured to be operated by a user in order to drive the LED lamp beads 23. In this embodiment, the controller 30 is connected to one end of the conductive wire 22, at least includes a power source 31 and a switch 32, and is configured to drive, or stop driving, the LED lamp beads 23 to emit light.

The light-permeable protective enclosures 40 are configured mainly to enclose the LED lamp beads 23 respectively, thereby securing each LED lamp bead 23 to the net string 12, protecting the LED lamp beads 23, and diffusing the light of the LED lamp beads 23. Each light-permeable protective enclosure 40 is provided with and penetrated by a receiving groove 411 for receiving the corresponding LED lamp bead 23, allowing passage of the net string 12, and thus securing the corresponding LED lamp bead 23 in position on the net string 12.

Figure 2:
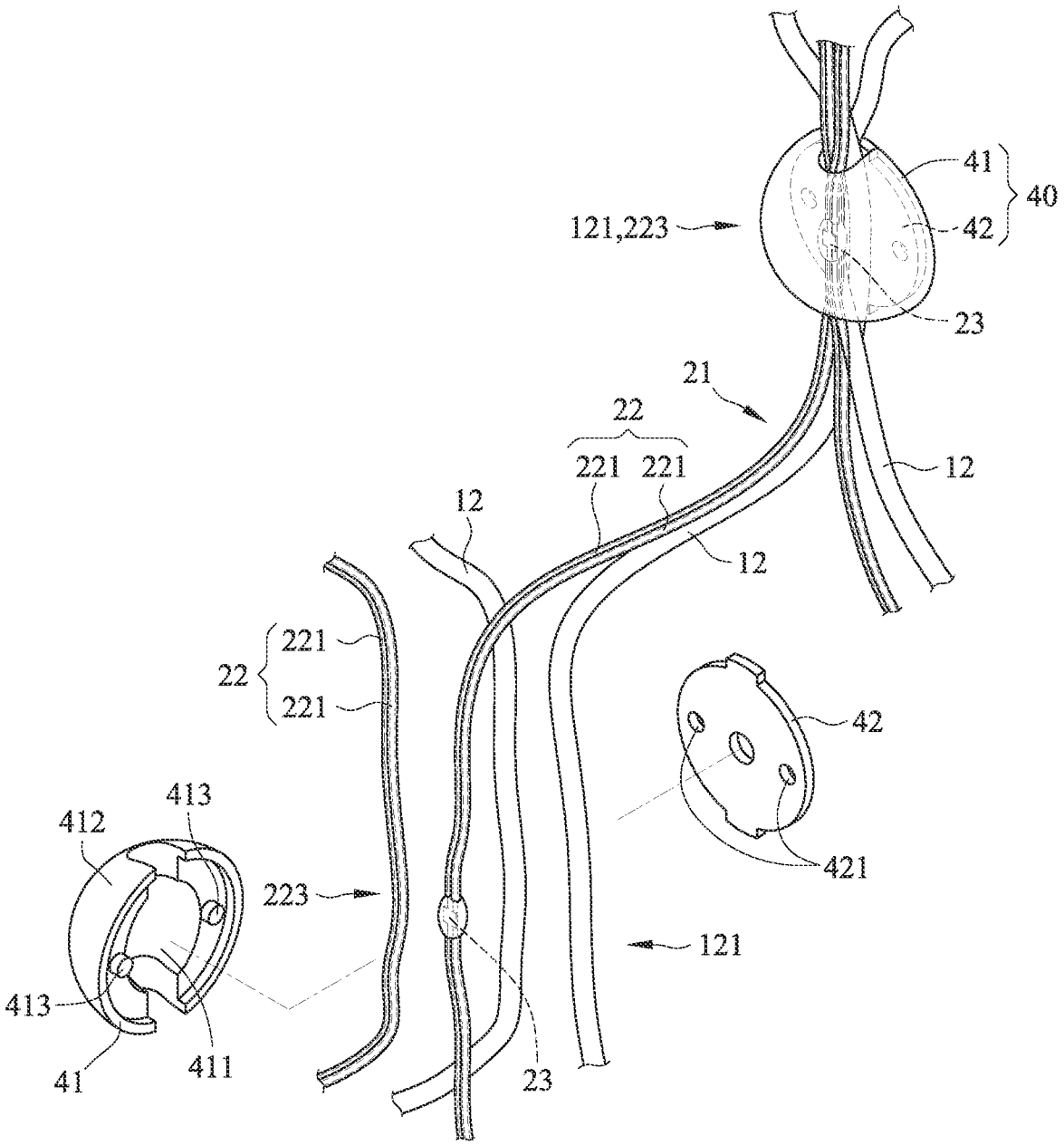
FIG. 2 is a structural diagram showing how a light-permeable protective enclosure puts a net string and a double-wire cable together.
Figure 3:
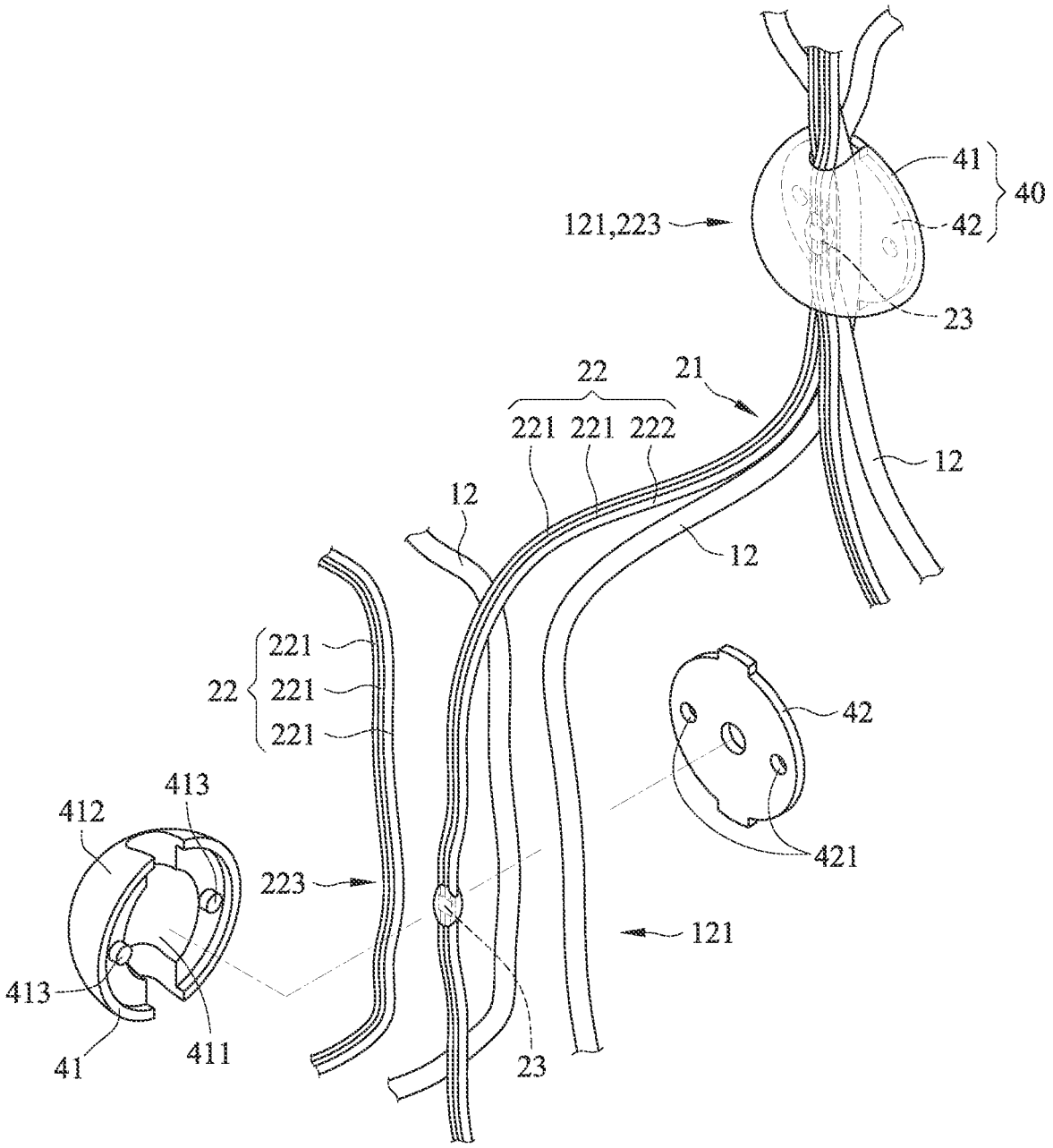
FIG. 3 is a structural diagram showing how a light-permeable protective enclosure puts a net string and a triple-wire cable together.
Figure 4:
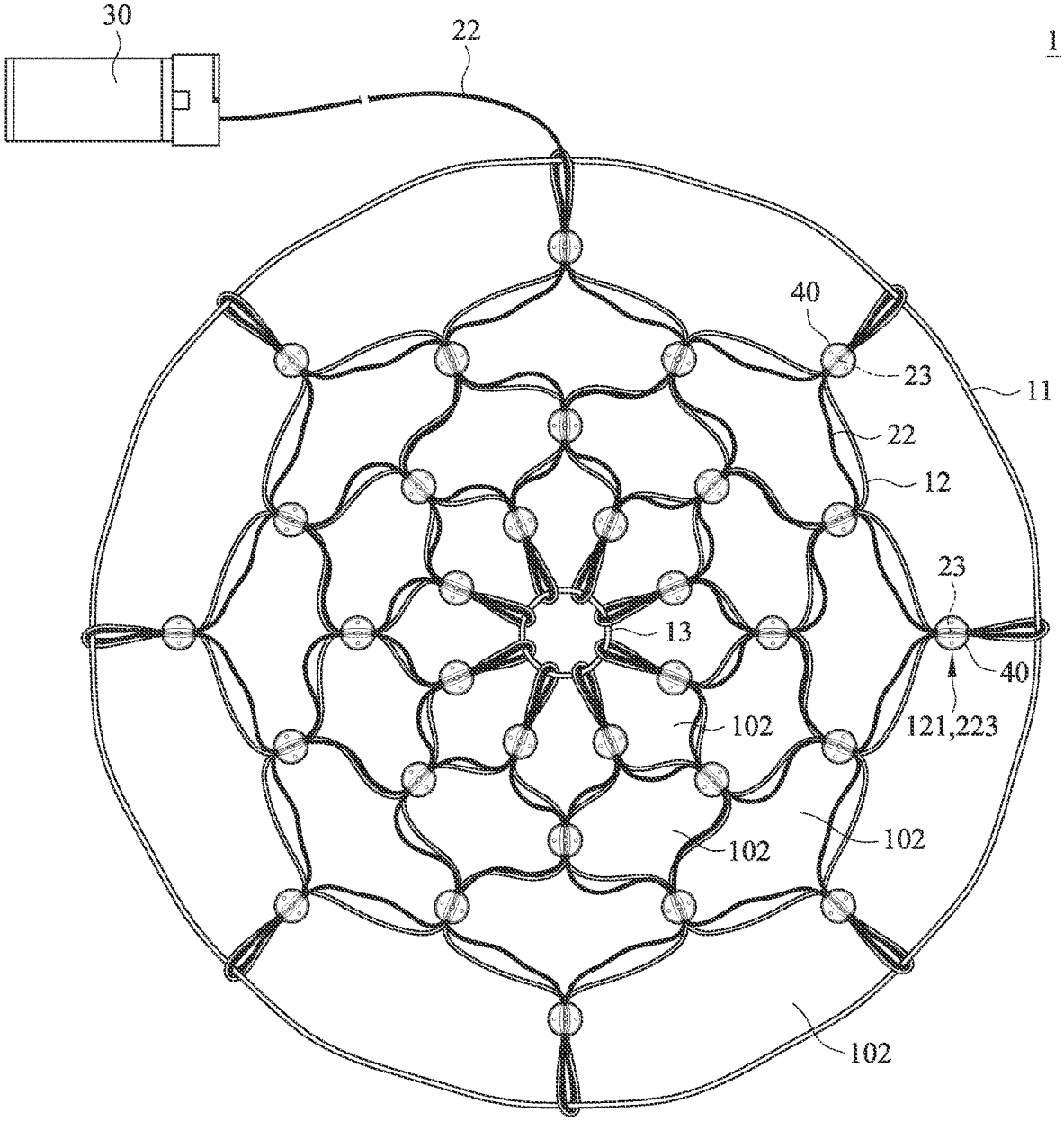
FIG. 4 is a plan view of the embodiment illustrated in FIG. 1.

As shown in FIG. 2 and FIG. 3, the receiving groove 411 of each light-permeable protective enclosure 40 also allows passage of the conductive wire 22 of the light string 21 in order to maintain the relative positions of the corresponding LED lamp bead 23, the conductive wire 22, and the net string 12. Furthermore, each light-permeable protective enclosure 40 in this embodiment encloses and secures the corresponding net string junction 121, the corresponding conductive wire junction 223, and the LED lamp bead 23 at the corresponding conductive wire junction 223.

In this embodiment, each light-permeable protective enclosure 40 includes a main body 41 and a cover 42 that are configured to couple with each other. Each main body 41 is generally hemispherical, forms a hemispherical outer surface 412 on the side facing away from the corresponding cover 42, and is concavely provided with the corresponding receiving groove 411 on the side adjacent to the corresponding cover 42, with the corresponding receiving groove 411 penetrating two opposite lateral sides of the main body 41. Each cover 42 is plate-shaped and is configured to cover the side of the corresponding receiving groove 411 that faces away from the corresponding main body 41. In addition, each main body 41 and the corresponding cover 42 are respectively provided at corresponding positions with two tenons 413 and two mortises 421, wherein the tenons 413 and the mortises 421 are configured to engage with each other respectively. These simple engaging and positioning structures help increase the efficiency of manufacture and assembly.

In a feasible embodiment of the present invention, referring to FIG. 2, the conductive wire 22 of the light string 21 is structured as a double-wire cable and includes two power supply wires 221 that extend parallel to each other, and the LED lamp beads 23 are connected in parallel between the two power supply wires 221. The conductive wire 22 of the light string 21 may alternatively be structured as a triple-wire cable or include even more constituent wires. In FIG. 3, for example, the conductive wire 22 is a triple-wire cable and further includes a signal wire 222 that extends parallel to the two power supply wires 221 in order to enable signal communication between the controller 30 and the LED lamp beads 23, the objective being to be able to instruct each LED lamp bead 23 to carry out a different light-emitting operation.

In this embodiment, the LED lamp beads 23 of the light string 21 are mainly SMD LEDs, and each section of the conductive wire 22 that extends between two adjacent light-permeable protective enclosures 40 is slightly longer than each section of the net string 12 that extends between two adjacent light-permeable protective enclosures 40. The difference in length ensures that a force applied to the light-emitting assembly 20 will act on the net string 12 first, and that the durability of the light-emitting assembly 20 is thus enhanced.

Figure 5:
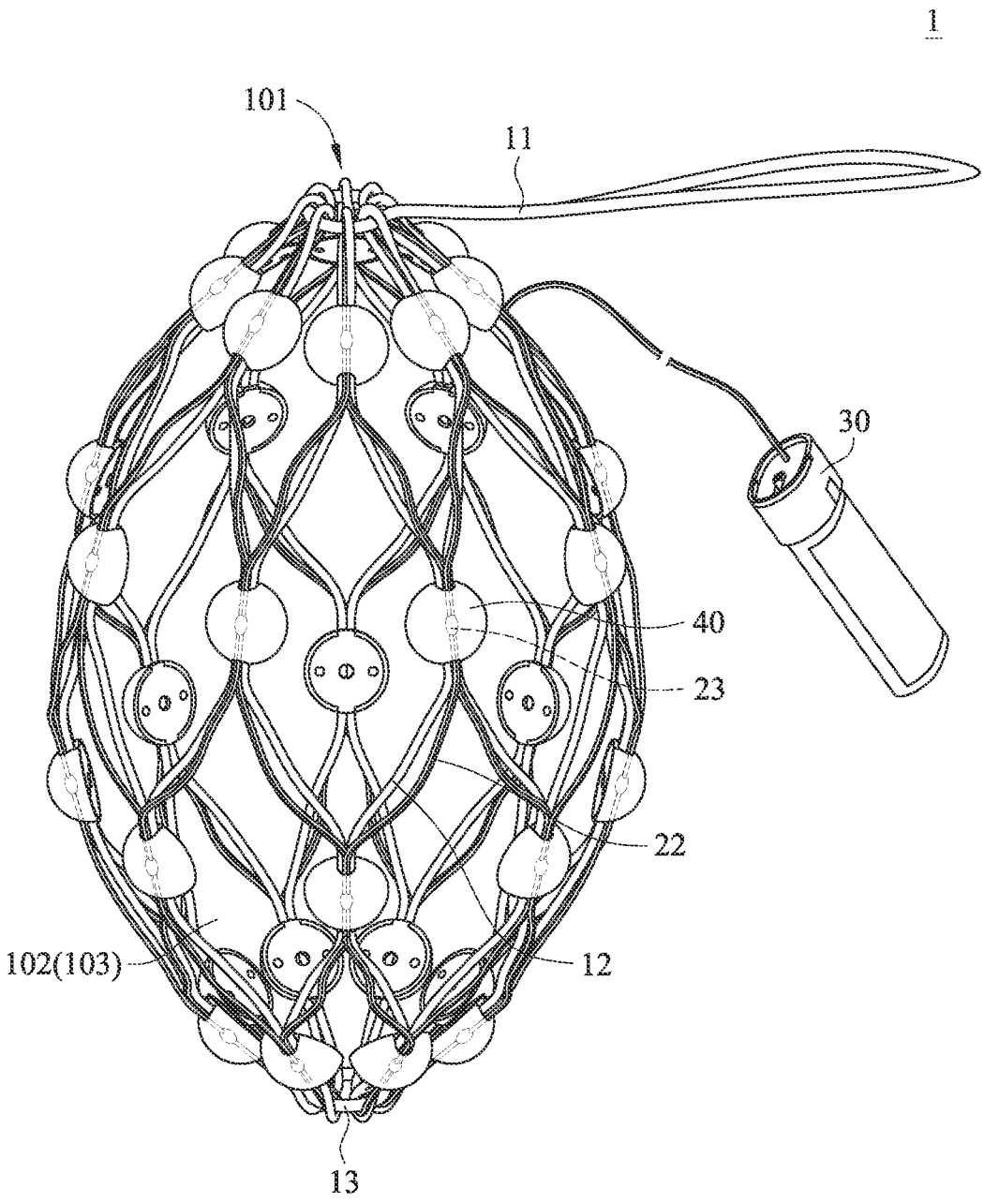
FIG. 5 shows a state of use of the embodiment illustrated in FIG. 1.

In terms of use, referring to FIG. 5, a user can tighten the bag opening 101 by operating the drawstring 11 so that the decorative light-emitting net bag 1 forms an openwork light decoration that can be disposed on its own. The free-hanging portion of the drawstring 11 can also be hung at a desired position to turn the decorative light-emitting net bag 1 into a hanging light decoration.

Figure 6:
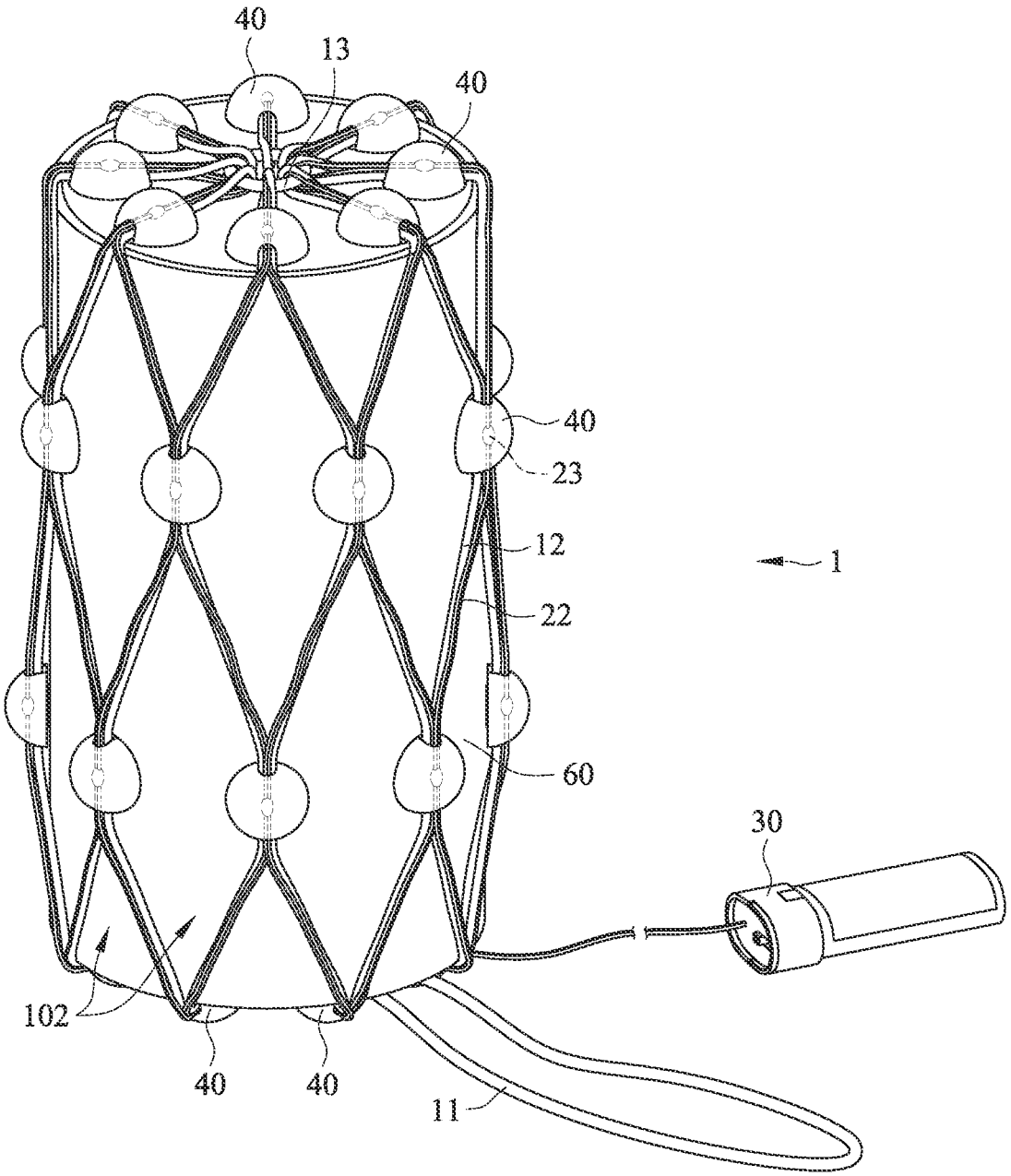
FIG. 6 and FIG. 7 show other states of use of the embodiment illustrated in FIG. 1.
Figure 7:
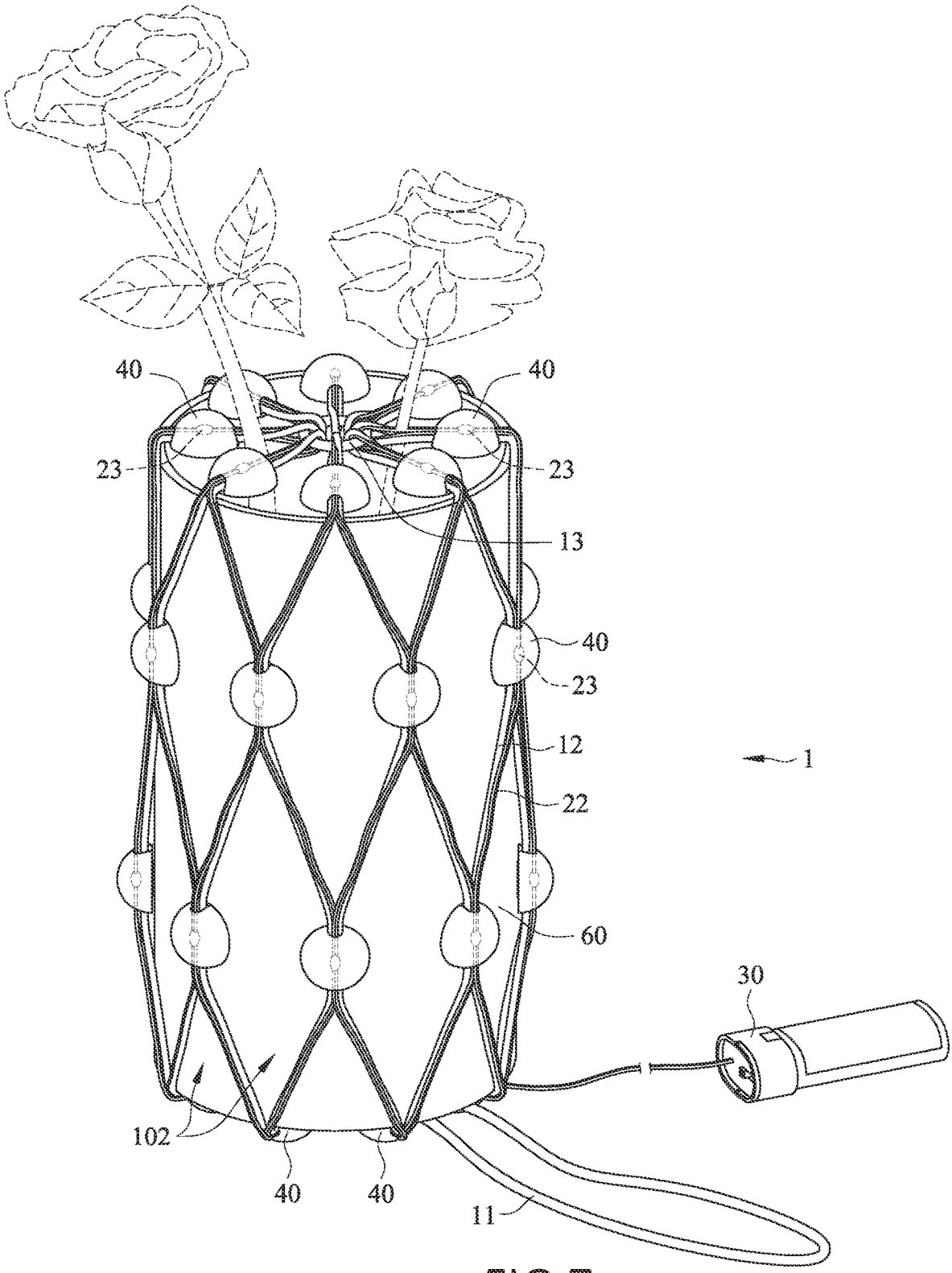
Figure 9:
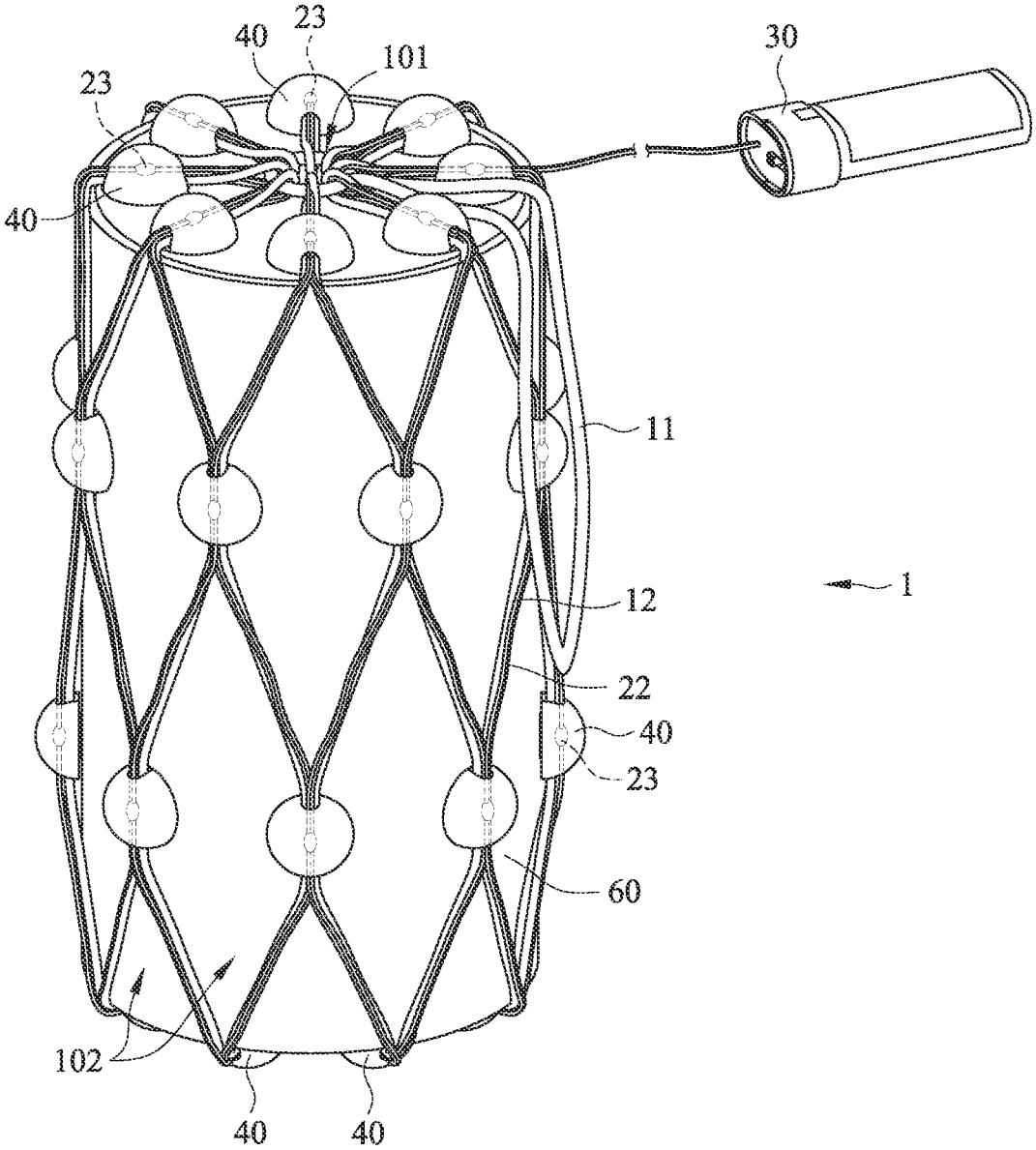
FIG. 9 shows yet another state of use of the embodiment illustrated in FIG. 1.

Moreover, a user may mount the decorative light-emitting net bag 1 over a to-be-decorated object 60, either with the bag opening 101 facing down (as shown in FIG. 6 and FIG. 7) or with the bag opening 101 facing up (as shown in FIG. 9), and then tighten the bag opening 101 by operating the drawstring 11 in order to coat the outer surface of the to-be-decorated object 60 with the decorative light-emitting net bag 1 as if the to-be-decorated object 60 is wearing a piece of clothes that not only provides a unique exterior decoration, but also can produce a lighting effect when the lights are turned on. The to-be-decorated object 60 is shown in FIG. 7 as a container in which flowers can be arranged, i.e., a vase. When the vase is decorated with the decorative light-emitting net bag 1, the LED lamp beads 23 can produce an eye-catching lighting effect by illuminating the flowers directly from below.

Figure 8:
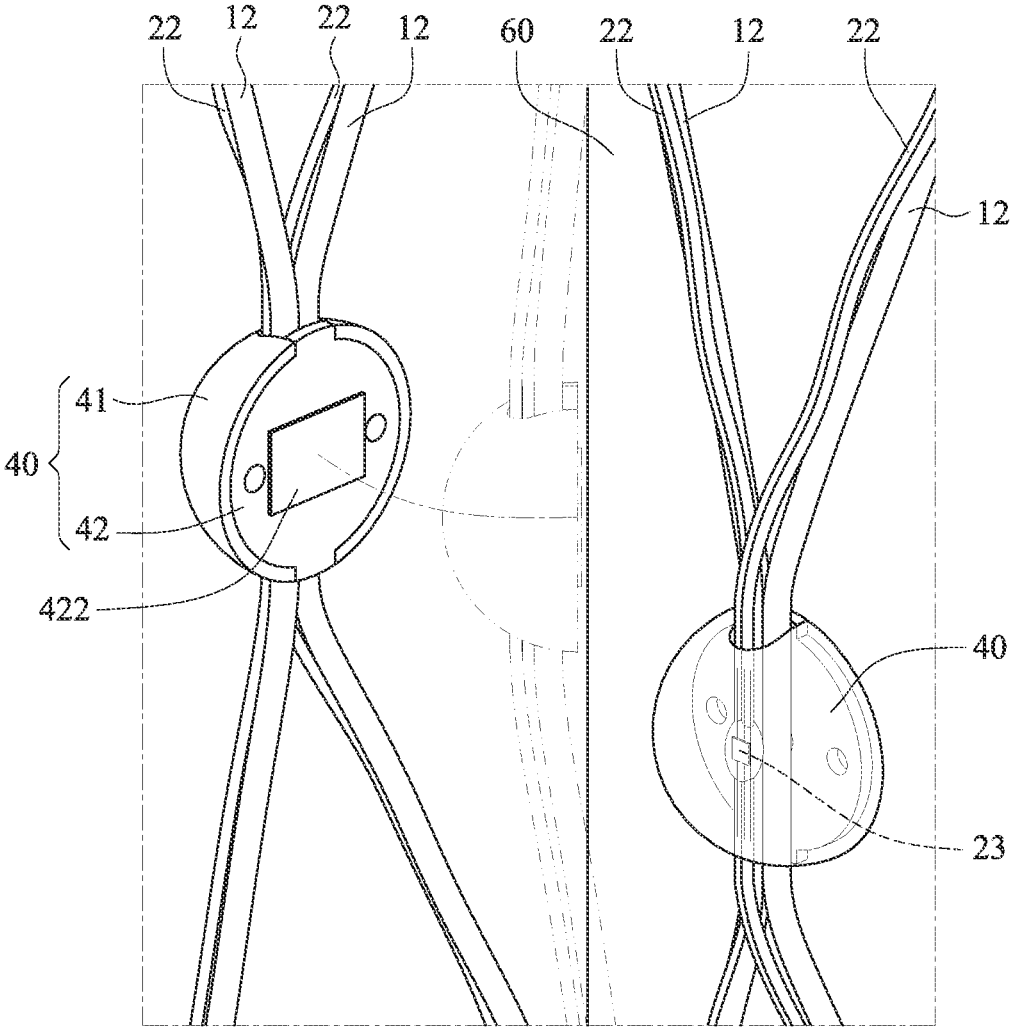
FIG. 8 shows how a light-permeable protective enclosure is positioned on and attached to the outer surface of a to-be-decorated object.

In a feasible embodiment, referring to FIG. 8, the cover 42 of each light-permeable protective enclosure 40 is further provided with an attaching portion 422 on the side facing away from the corresponding main body 41, wherein the attaching portion 422, such as a 3C adhesive patch with release paper, is configured to be positioned on the outer surface of the to-be-decorated object 60 so that the light-permeable protective enclosures 40 can be adhesively attached to the outer surface of the to-be-decorated object 60 (e.g., a vase) when desired or required.

Figure 10:
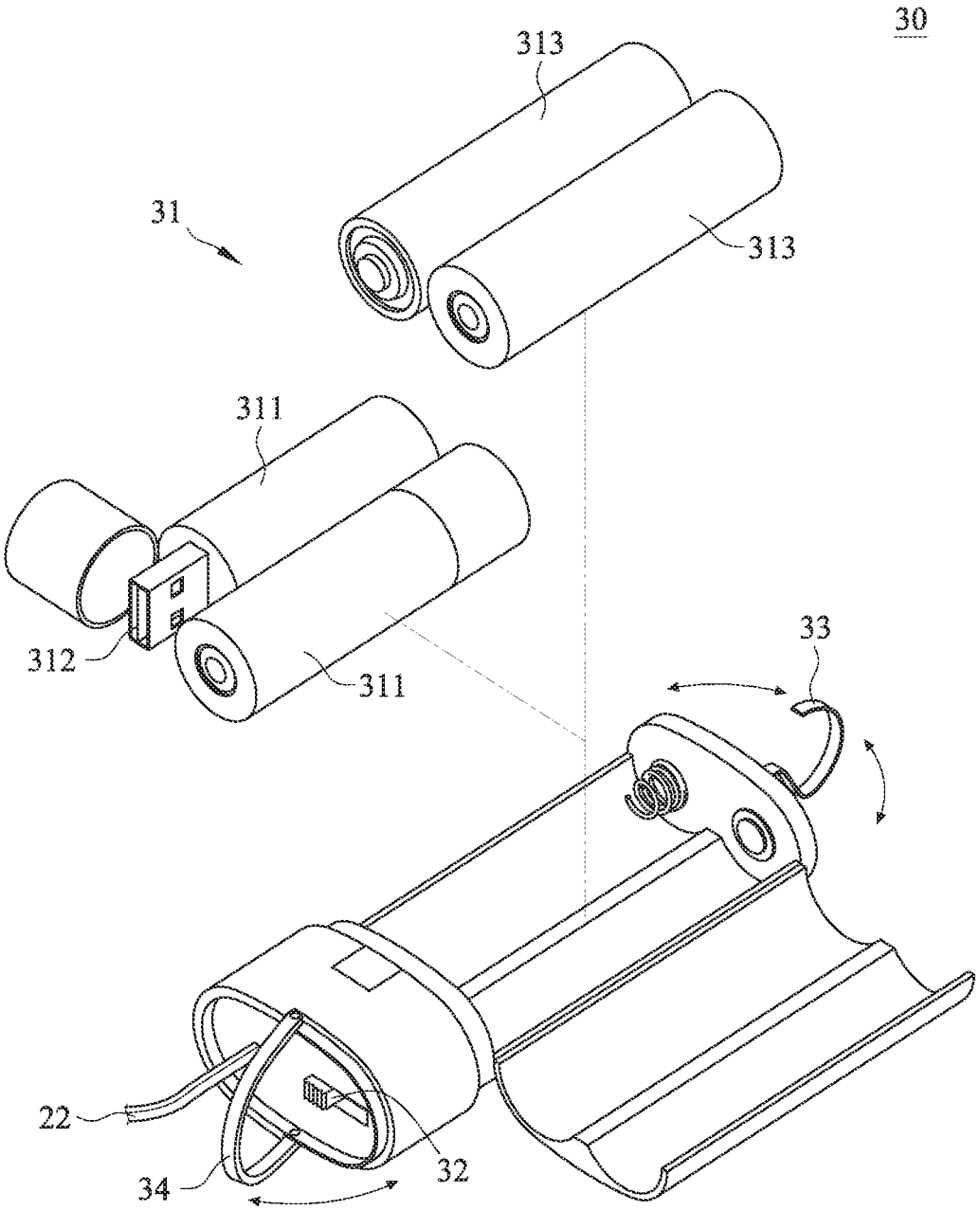
FIG. 10 shows the structure of the controller in the embodiment illustrated in FIG. 1.

The controller 30 may in practice be configured in various ways. For example, the power source 31 may be a built-in electricity storage unit that can be recharged repeatedly or, as shown in FIG. 10, a detachable/re-installable electricity storage unit 311, 313. The electricity storage unit 311, 313 may be a battery for single use (i.e., the electricity storage unit 313) or the electricity storage unit 311, which is configured for repeated use. The reusable electricity storage unit 311 is provided at least with a connection port 312 for connecting and delivering external electricity to the electricity storage unit 311. In the other words, the connection port 312 is provided for connecting with an external power source and delivering electricity to the electricity storage unit 311 to store electricity therefrom.

In this embodiment, each of the head and tail sides of the controller 30 may be provided with a hook 33 or a hanging portion 34. Each of the hook 33 and the hanging portion 34 may be configured as a foldable hidden structure so as to be turned up for use and folded down, and thus hidden from view, when not in use.

Figure 11:
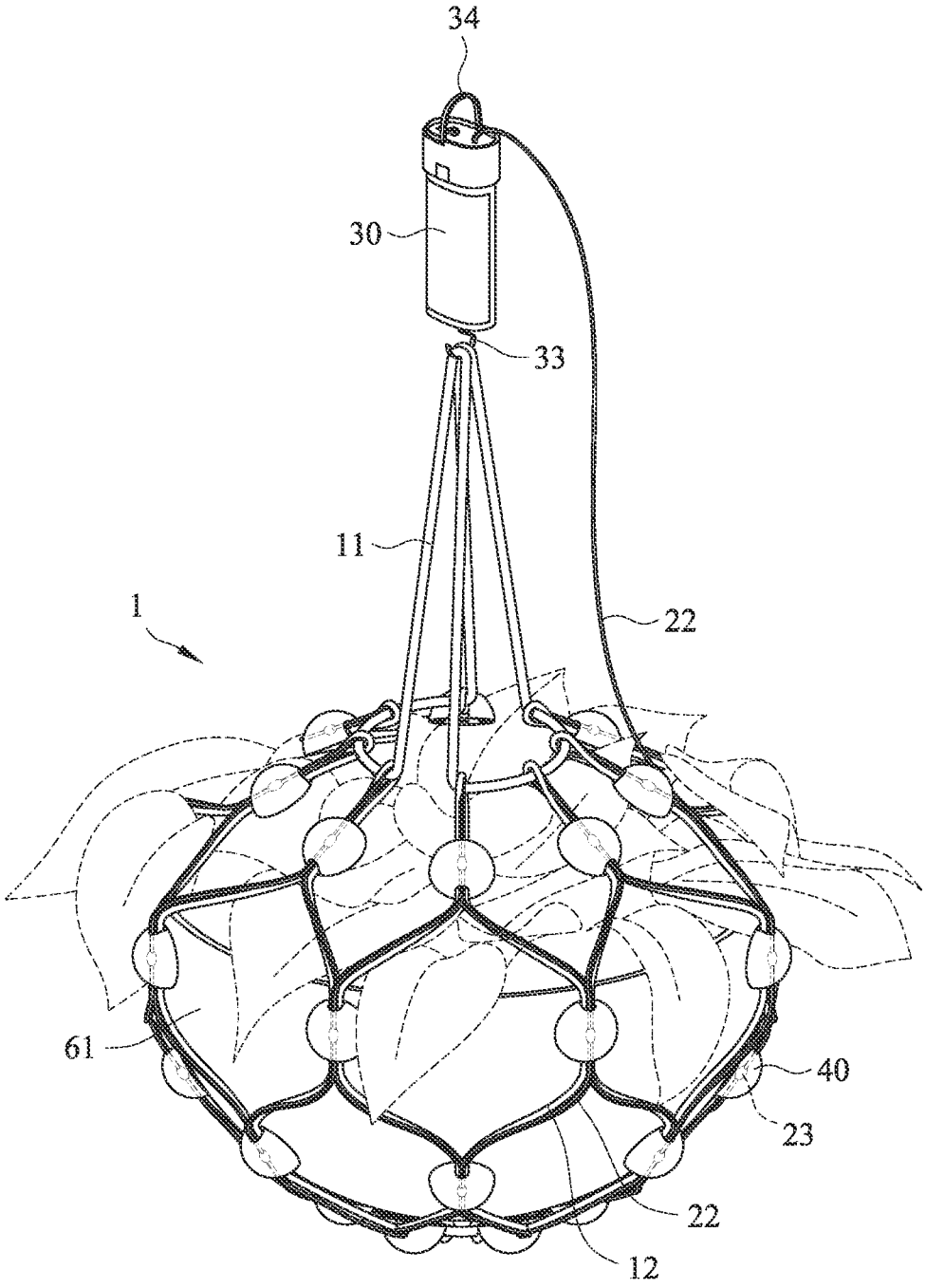
FIG. 11 shows still another state of use of the embodiment illustrated in FIG. 1.

In terms of use, referring to FIG. 11, the receiving space 103 of the net bag 10 can be used to receive a to-be-decorated object 61, and once the bag opening 101 is tightened by operating the drawstring 11, the free-hanging portion of the drawstring 11 can be hung directly from the hook 33 of the controller 30 while the hanging portion 34 (or another hook 33) on the opposite side of the controller 30 is hung at a desired position. Thus, the decorative light-emitting net bag 1 and the to-be-decorated object 61 can be easily turned into a hanging light decoration.

Figure 12:
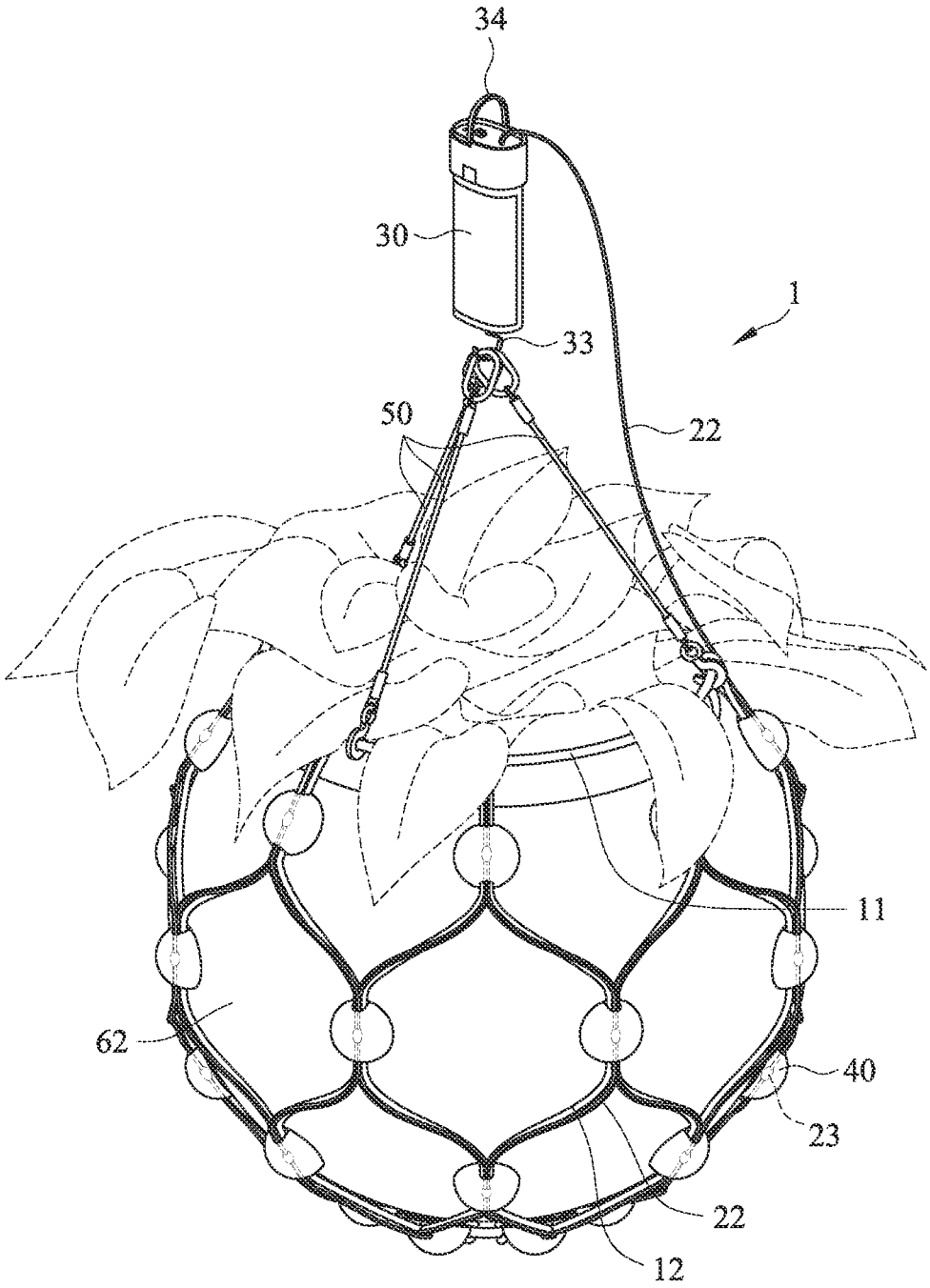
FIG. 12 shows a further state of use of the embodiment illustrated in FIG. 1.

Referring to FIG. 12, when the net bag 10 is used to receive a larger to-be-decorated object 62 than the to-be-decorated object 61, the drawstring 11 may not be available for hanging directly from the hook 33 of the controller 30. In that case, a set of hanging cords 50, or a plurality of hanging cords 50, may be used to connect the drawstring 11 to the hook 33 so that the to-be-decorated object 62 can be hung under the controller 30 via the decorative light-emitting net bag 1 while the hanging portion 34 (or another hook 33) on the opposite side of the controller 30 is hung at a desired position. Thus, the decorative light-emitting net bag 1 and the to-be-decorated object 62 can be easily arranged as a whole to form a hanging light decoration.

According to the above, the decorative light-emitting net bag 1 of the present invention is novel and unique, is indeed easy to use and capable of a diversity of applications, and satisfies the requirements for patentability. The embodiments described above, however, are only some preferred ones of the invention. Any extension, modification, simple change, or equivalent substitution based on the technical means of the invention shall fall within the scope of the appended claims.

What is claimed is:

1. A decorative light-emitting net bag, comprising:

a net bag with a plurality of mesh openings, wherein the net bag has a side provided with a bag opening and is formed with a receiving space in the net bag in order to receive or be mounted over a to-be-decorated object;

a light-emitting assembly comprising a plurality of light-emitting diode (LED) lamp beads distributed on the net bag; and a plurality of light-permeable protective enclosures for enclosing the LED lamp beads respectively and securing each said LED lamp bead to at least one net string of the net bag;

wherein each said light-permeable protective enclosure is provided with and penetrated by a receiving groove for receiving a corresponding said LED lamp bead and allowing passage of the net string so as to secure the corresponding LED lamp bead in position on the net string.

2. The decorative light-emitting net bag of claim 1, wherein the light-emitting assembly comprises at least one light string, the light string comprises a linearly extending conductive wire, the LED lamp beads are provided at intervals on the conductive wire, and the receiving groove of each said light-permeable protective enclosure further allows passage of the conductive wire so as to secure the corresponding LED lamp bead, the conductive wire, and the net string in position.

3. The decorative light-emitting net bag of claim 2, wherein each section of the conductive wire that extends between two adjacent said light-permeable protective enclosures is not shorter than each section of the net string that extends between two adjacent said light-permeable protective enclosures.

4. The decorative light-emitting net bag of claim 2, wherein the LED lamp beads are surface-mount-device (SMD) LEDs.

5. The decorative light-emitting net bag of claim 2, wherein the net bag further comprises a drawstring for tightening the bag opening.

6. The decorative light-emitting net bag of claim 5, wherein the net bag has a side located away from the bag opening and provided with a ring-shaped bag eyelet, and the net string extends sinuously between the drawstring and the bag eyelet to form therebetween a plurality of net string junctions, where the net string meets itself, and the mesh openings.

7. The decorative light-emitting net bag of claim 6, wherein the light string extends sinuously between the drawstring and the bag eyelet, and each said light-permeable protective enclosure is configured to secure the corresponding LED lamp bead and the conductive wire to a corresponding said net string junction.

8. The decorative light-emitting net bag of claim 7, wherein the light string forms between the drawstring and the bag eyelet a plurality of conductive wire junctions corresponding respectively to the net string junctions, and each said light-permeable protective enclosure is configured to enclose and secure the corresponding net string junction, a corresponding said conductive wire junction, and a said LED lamp bead at the corresponding conductive wire junction.

9. The decorative light-emitting net bag of claim 2, wherein each said light-permeable protective enclosure comprises a main body penetrated by the receiving groove, and the main body forms a generally hemispherical outer surface on a lateral side of the corresponding receiving groove.

10. The decorative light-emitting net bag of claim 2, wherein each said light-permeable protective enclosure comprises a main body and a cover, each said main body has a side adjacent to a corresponding said cover and concavely provided with a corresponding said receiving groove penetrating two opposite lateral sides of the each said main body, each said receiving groove has a side facing away from a corresponding said main body and covered by a corresponding said cover, and each said main body has a side facing away from the corresponding cover and forming a generally hemispherical outer surface.

11. The decorative light-emitting net bag of claim 10, wherein each said main body is provided with one of at least one tenon and at least one mortise engageable with the at least one tenon, and each said cover is provided with the other of the at least one tenon and the at least one mortise.

12. The decorative light-emitting net bag of claim 11, wherein each said cover has a side facing away from a corresponding said main body and provided with an attaching portion configured to be positioned on an outer surface of the to-be-decorated object.

13. The decorative light-emitting net bag of claim 5, wherein the conductive wire comprises two power supply wires extending parallel to each other, and each said LED lamp bead is connected in parallel between the two power supply wires.

14. The decorative light-emitting net bag of claim 13, wherein the light-emitting assembly further comprises a controller connected to one end of the conductive wire, and the controller is provided at least with a power source and a switch in order to drive, or stop driving, the LED lamp beads to emit light.

15. The decorative light-emitting net bag of claim 14, wherein the conductive wire further comprises a signal wire extending parallel to the two power supply wires in order to enable signal transmission between the controller and the LED lamp beads.

16. The decorative light-emitting net bag of claim 14, wherein the power source comprises at least one electricity storage unit detachably connected to the controller.

17. The decorative light-emitting net bag of claim 16, wherein the electricity storage unit is further provided with a connection port for delivering external electricity to the electricity storage unit.

18. The decorative light-emitting net bag of claim 14, wherein the controller is further provided with at least one hook or hanging portion.

19. The decorative light-emitting net bag of claim 14, wherein the controller has two opposite sides each provided with a hook or a hanging portion, the hook or the hanging portion on one of the two opposite sides of the controller is configured to allow the controller to be hung, and the hook or the hanging portion on the other of the two opposite sides of the controller is configured to allow the drawstring to be hung from the controller.

20. The decorative light-emitting net bag of claim 14, wherein the controller has two opposite sides each provided with a hook or a hanging portion, the hook or the hanging portion on one of the two opposite sides of the controller is configured to allow the controller to be hung, and the hook or the hanging portion on the other of the two opposite sides of the controller is configured to allow the drawstring to be hung from the controller via at least one hanging cord.

* * * * *